US010183768B2

(12) United States Patent
Payne

(10) Patent No.: US 10,183,768 B2
(45) Date of Patent: Jan. 22, 2019

(54) PALLET THREADING APPARATUS

(71) Applicant: Kenneth M. Payne, Dublin, CA (US)

(72) Inventor: Kenneth M. Payne, Dublin, CA (US)

( * ) Notice: Subject to any disclaimer, the term of this patent is extended or adjusted under 35 U.S.C. 154(b) by 621 days.

(21) Appl. No.: 14/972,085

(22) Filed: Dec. 17, 2015

(65) Prior Publication Data

US 2017/0174373 A1 Jun. 22, 2017

(51) Int. Cl.
*B65B 13/04* (2006.01)
*B65B 13/08* (2006.01)
*B65B 13/02* (2006.01)

(52) U.S. Cl.
CPC ..... *B65B 13/025* (2013.01); *B65B 13/08* (2013.01)

(58) Field of Classification Search
CPC ..... B65B 13/08; B65B 13/025; B65B 13/027
See application file for complete search history.

(56) References Cited

U.S. PATENT DOCUMENTS 4,106,403 A 8/1978 Sutehall
4,119,023 A 10/1978 Boe et al.
5,355,786 A 10/1994 Tipton et al.
6,568,159 B2 5/2003 Kawai et al.
6,749,382 B2 6/2004 Lambie
2004/0052604 A1* 3/2004 Lambie ..... B65B 13/025 410/97
2011/0023730 A1* 2/2011 Anderson ..... B65B 13/025 100/34

FOREIGN PATENT DOCUMENTS

DE 10011909 A1 * 9/2001 ..... B65B 13/025
EP 2648981 A1 6/2014
WO WO 2012078086 A1 * 6/2012 ..... B65B 13/025

* cited by examiner

*Primary Examiner* — Jimmy T Nguyen
(74) *Attorney, Agent, or Firm* — Christopher Pilling

(57) ABSTRACT

A pallet threading apparatus including a directional handle; a flexible rod having a first end and a second end; a football shaped head member having a top portion and bottom portion, the top portion including a longitudinal slot; the directional handle is attached to the first end and the football shaped head member is attached to the second end; a cleat element positioned in the longitudinal slot, the cleat element including a pair of side walls having a plurality of oppositely opposed teeth for retaining a section of strapping material.

19 Claims, 7 Drawing Sheets

PALLET THREADING APPARATUS

CROSS-REFERENCE TO RELATED APPLICATIONS

N/A

BACKGROUND OF THE INVENTION

1. Field of the Invention

The present invention relates to a pallet threading apparatus for threading strapping material through the underside of a pallet for securing loads on the pallet.

2. Description of Related Art

When securing a load to a pallet, strapping (also known as banding) material is "threaded" between the top and bottom deck boards of the pallet and securely wrapped around the load, usually with two straps in each direction. Using conventional methods, it is particularly difficult, and ergonomically strenuous, to get the strapping or banding material though the pallet as is necessary to secure the load.

Several techniques, tools, and processes are available, yet they have significant disadvantages. U.S. Pat. No. 6,749,382 to Lambie teaches a guide for banding material comprising a handle having a slotted head allowing strapping material to be threaded through the head. The handle and corresponding strapping material is then passed underneath the pallet. However, the process cannot be performed from a standing position, and the process of threading the strapping material into the slotted head may be difficult and time consuming when many pallets and loads need to be secured. Another known method, U.S. Pat. No. 4,119,023 to Boe et al. teaches a portable pallet strapping device comprising a large frame having a number of threader bars designed to be situated above and below a pallet with a load. Strapping material is directed along the threader bars, which is then removed from the device to secure the load. However, this device is extremely bulky and difficult to operate. Consequently, there is a need for a pallet threading apparatus that is efficient, quick to load, and easy to operate, while having a small footprint when not in use.

BRIEF SUMMARY OF THE INVENTION

In one embodiment of the present invention a pallet threading apparatus is provided, comprising a directional handle; a flexible rod having a first end and a second end; a football-shaped head member having a top portion and bottom portion, the top portion including a longitudinal slot; the directional handle is attached to the first end and the football shaped head member is attached to the second end; a cleat element is positioned in the longitudinal slot, the cleat element comprising a pair of side walls having a plurality of oppositely opposed teeth for retaining a section of strapping material. In one embodiment, the pair of side walls each having a number of protruding tabs corresponding to a number of receiving spaces located in the top portion. In one embodiment, the present invention further comprises at least one rectangular male fastener located in the longitudinal slot corresponding to at least one female receiving area located at the bottom, between the pair of sidewalls. In another embodiment, each of the plurality of oppositely opposed teeth includes a top surface, a distal surface, and a bottom surface. In yet another embodiment, the longitudinal slot has a substantial U-shape configuration creating a longitudinal channel located below the bottom surface extending the length of the cleat.

In one embodiment, the top surface comprises an angled surface. In another embodiment, the angled surface enables the section of strapping material to be positioned in the plurality of oppositely opposed teeth without the top surface obstructing the positioning. In one embodiment, the distal surface has a slight angle in relation to the bottom surface.

In one embodiment, the present invention further comprises a distance between the distal surfaces of the plurality of oppositely opposed teeth, wherein the distance varies by depth due to the slight angle creating a first depth and a corresponding first distance adjacent to the top surface and a second depth and a corresponding second distance adjacent to the bottom surface, wherein the first distance is greater than the second distance. In another embodiment, the distance between the distal surfaces of the plurality of oppositely opposed teeth enables strapping materials of various widths and thicknesses to be used.

In one embodiment, the directional handle comprises a thumb guide aligned with the cleat element. In another embodiment, the plurality of oppositely opposed teeth is constructed from an elastic material enabling the plurality of oppositely opposed teeth to flex, the flex enabling the plurality of oppositely opposed teeth to include an open position and a closed position, wherein the strip of strapping material is loaded in the open position and retained in the closed position. In yet another embodiment, the longitudinal channel allows any accumulation of debris to be cleared by applying pressurized air through the longitudinal channel. In one embodiment, the pair of side walls includes a plurality of vertical studs stabilizing the side walls against the head's longitudinal slot in an upright position during operation.

In another aspect of the invention, an apparatus is provided comprising a handle; a flexible rod; a head member having a top portion and bottom portion, the top portion including a longitudinal slot; the handle is attached to the first end and the head member is attached to the second end; a cleat element positioned in the longitudinal slot, the cleat element comprising a pair of side walls having a plurality of oppositely opposed teeth.

In one embodiment, the head member is constructed from a shape including no blunt edges or protruding surfaces. In one embodiment, the plurality of oppositely opposed teeth is designed to retain a strip of strapping material. In another embodiment, the plurality of oppositely opposed teeth includes an open position and a closed position, wherein the strip of strapping material is loaded in the open position and retained in the closed position. In yet another embodiment, the flexible rod is constructed from fiberglass allowing the flexible rod to bend in any 360 degree direction.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a pallet threading apparatus for threading strapping material through the underside of a pallet.

Figure 1:
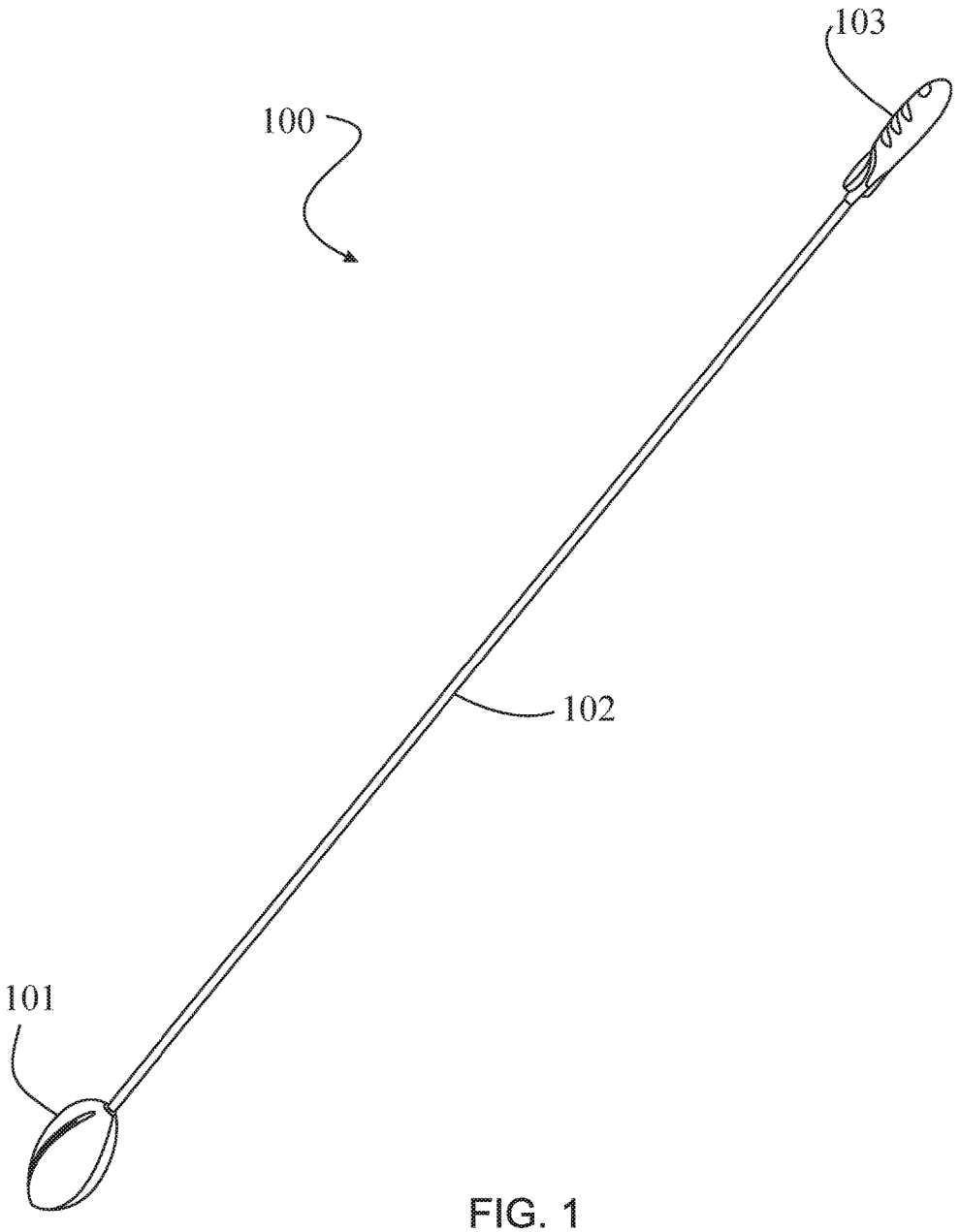
FIG. 1 is a perspective view of a pallet threading apparatus according to an embodiment of the present invention.
Figure 6:
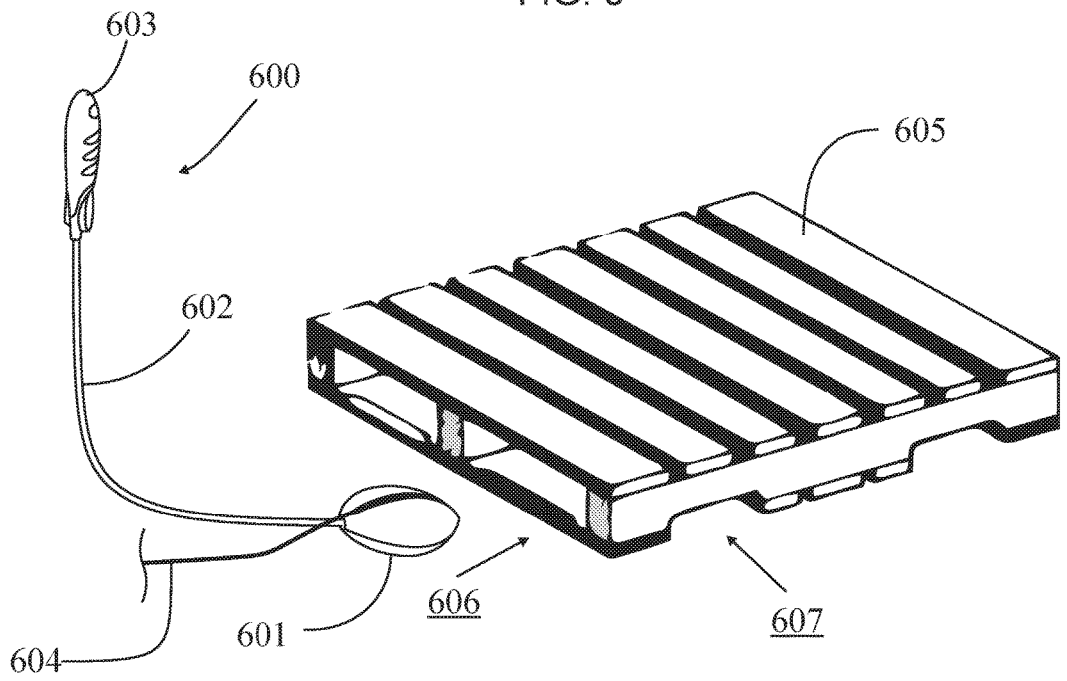
FIG. 6 is an exemplary perspective view illustrating a pallet threading apparatus in use according to an embodiment of the present invention.

FIG. 1 is a perspective view of a pallet threading apparatus 100 according to an embodiment of the present invention. Referring now to FIG. 1, the pallet threading apparatus comprises a head member 101, a flexible rod 102, and a directional handle 103. The head member is attached to a first end of the flexible rod, and the directional handle is attached to a second end of the flexible rod. The head member is preferably a football-like shape having no blunt edges or protruding surfaces. This ideal shape prevents the head member from snagging on or being impeded by any of the numerous surfaces found on a common wood pallet 605 (FIG. 6). In some embodiments, the head member is constructed from a spheroid shape, including an oblate spheroid and a prolate or elongated spheroid. In some embodiments, the head member is constructed from any spherical or curved shape having no blunt edges or protruding surfaces. It is critical that the head member does not allow any of the pallet surfaces to impede the movement of the apparatus through the underside of the pallet, either forward or backwards, during use. This will be described in greater detail below.

Still referring to FIG. 1, the flexible rod is made from a flexible material, including, but not limited to fiberglass, allowing the apparatus to bend in any direction, i.e. 360 degrees. For instance, when using the apparatus the flexible rod enables the user to stand at normal height and insert the apparatus through the underside of the pallet from any angle or position. This is advantageous, as the user doesn't need bend down to the height of the pallet to use the apparatus, preventing potential back injury or pain. This also enables the tool to be used when confined to tight spaces, such as adjacent pallets or nearby obstructions—a process that cannot be done with rigid rods commonly found in prior art.

Figure 2:
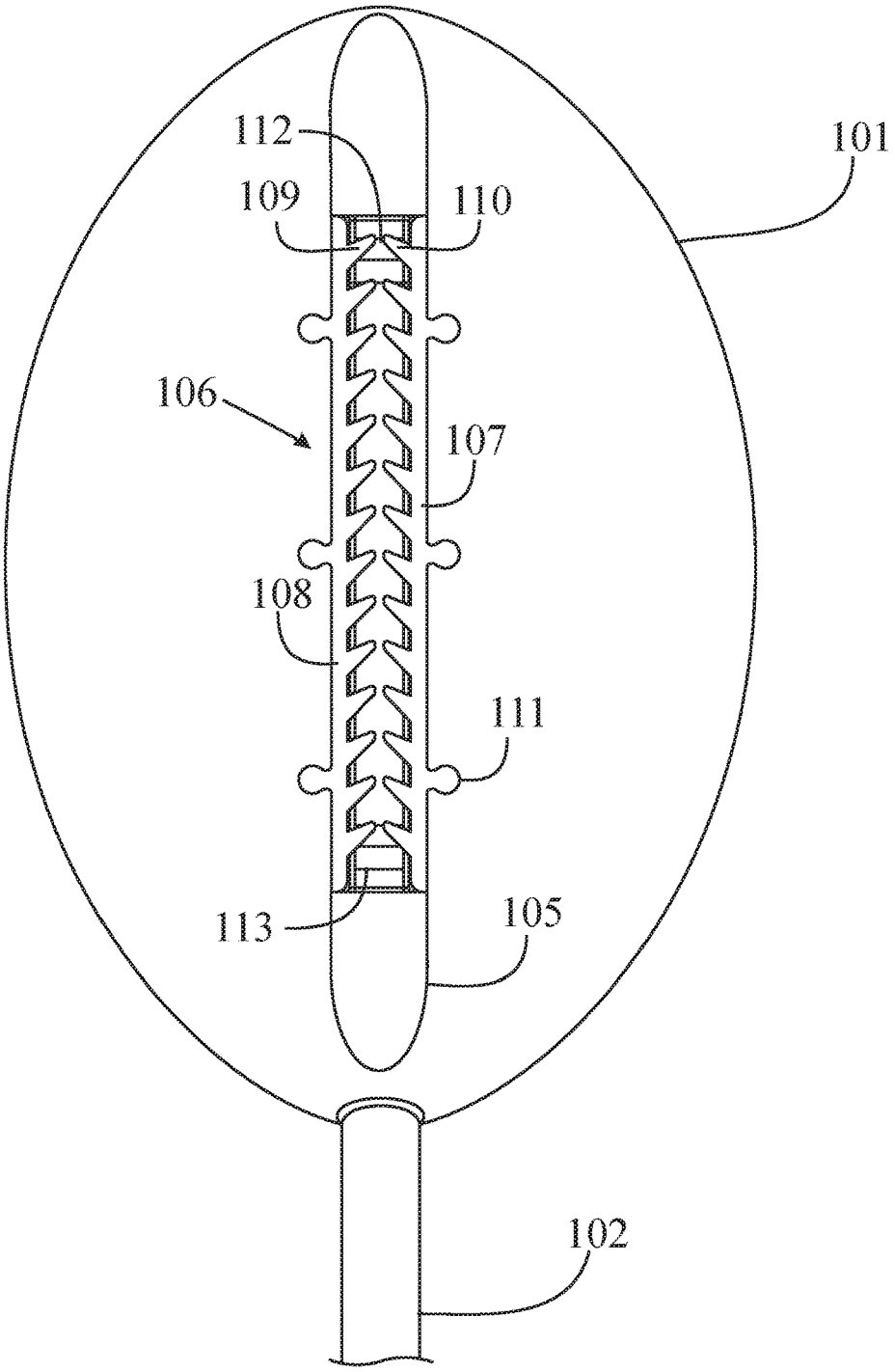
FIG. 2 is a top detailed view of a pallet threading apparatus according to an embodiment of the present invention.

FIG. 2 is a top detailed view of a pallet threading apparatus according to an embodiment of the present invention. Referring now to FIG. 2, a top detailed view of head member 101 is illustrated. As mentioned previously, the head member is attached to flexible rod 102 using suitable attachment means as well known in the art. The head member comprises a longitudinal slot 105 located in the top center surface of the head member. The slot provides a space for a cleat 106 to be inserted. The cleat includes side walls 107/108 having a plurality of oppositely opposed teeth 109/110 and a number of protruding studs 111 locating on both sides of the cleat, designed to aid in securing the cleat to the head member during use. The plurality of oppositely opposed teeth is made from an elastic material, including but not limited to rubber, silicone, urethane, thermoplastic or a combination thereof. The teeth are designed to engage strapping material during use, which will be discussed in greater detail below. The cleat further comprises at least one fastening means 112/113 formed in to the base of the cleat. In some embodiments, a first fastening means is positioned at one end of the cleat, and a second fastening means is positioned towards the opposite end of the cleat. Similarly to the fastening means, the protruding studs are used to help secure the cleat to the head member during use. Specifically, during engagement of strapping material in the plurality of oppositely opposed teeth (FIGS. 4A-B), lateral and longitudinal forces are present on the side walls and cleat respectively, the fastening means and the protruding studs ensure the cleat and side walls stay in position during these forces.

Figure 3A:
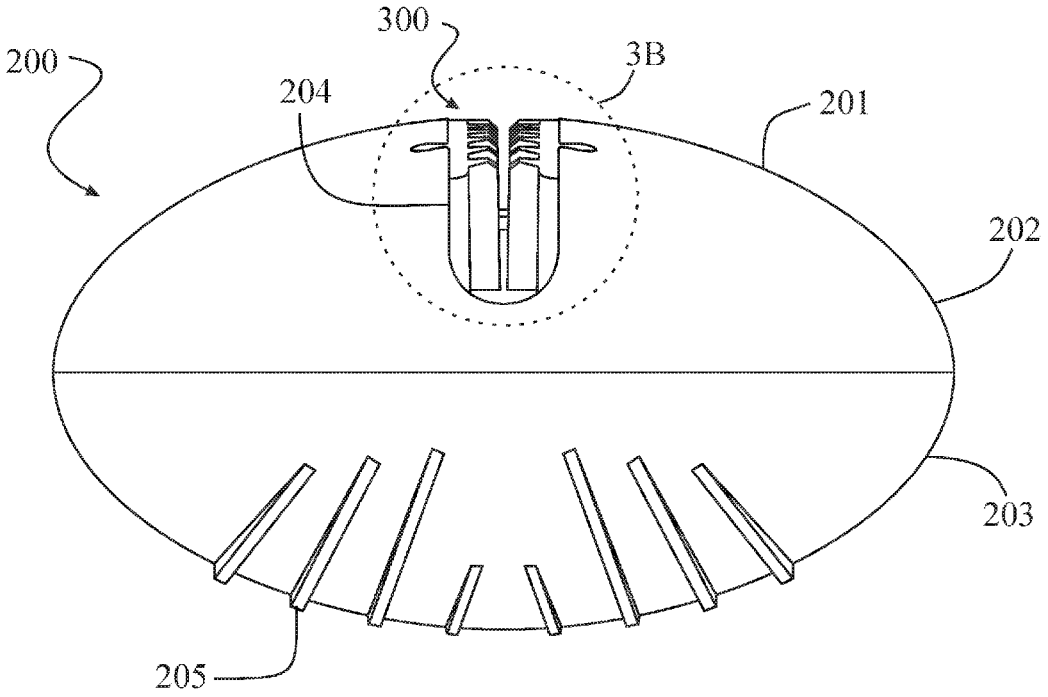
FIG. 3A is a front detailed view of a pallet threading apparatus according to an embodiment of the present invention.

FIG. 3A is a front detailed view of a pallet threading apparatus according to an embodiment of the present invention. Referring now to FIG. 3A, a front detailed view of head member 200 is illustrated. The head member has an elongated spheroid body 201 having a top portion 202 and bottom portion 203. The top portion includes a U-shaped longitudinal slot 204 for retaining a cleat 300, while allowing the strapping material to pass through the head member. The bottom portion includes a plurality of rails 205 positioned lengthwise radiating from the center of the bottom portion. The plurality of rails guide the apparatus during use and specifically aid in keeping the head member stabilized and in an upright position. The plurality of rails also aide in the tool's durability by adding additional wear surface. In alternative embodiments, the bottom portion does not include the plurality of rails.

Figure 3B:
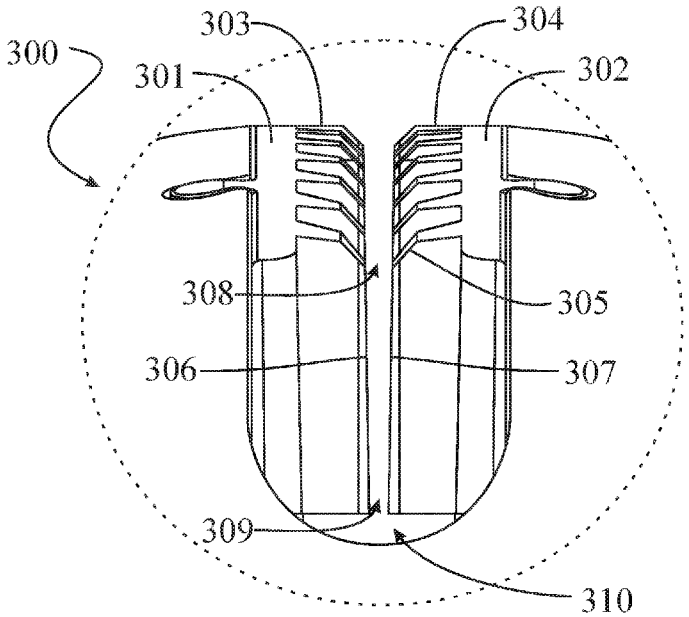
FIG. 3B is a detailed view taken from detail 3B of FIG. 3A.

FIG. 3B is a detailed view taken from detail B of FIG. 3A. Referring now to FIG. 3B, cleat 300 includes side walls 301/302 having a plurality of oppositely opposed teeth 303/304. Each of the teeth having an angled surface 305 located at the distal end of each of the plurality of oppositely opposed teeth. In some embodiments, the angle surface is approximately 45 degrees in a downward direction in relation to the top surface of the teeth. In alternative embodiments, the angle surface is not present at all. The angled surface enables strapping to be easily centered inside the cleat without the top teeth surface inhibiting the placement of the strapping. Further, the distance between each of the plurality of oppositely opposed teeth varies by depth. More specifically, the distance between each of the plurality of oppositely opposed teeth distal surfaces 306/307 becomes progressively narrower as the depth increases. For instance, at a first depth 308 the distance is wider than at a second depth 309. This inventive feature is designed to accommodate various strapping sizes as used in the art. The distance between the plurality of oppositely opposed teeth at the second depth has a narrower width than the width of the thinnest commonly available strapping material. Likewise, the distance between the plurality of oppositely opposed teeth at the first depth is narrower than the width of the thickest commonly available strapping material. This ensures the apparatus may be used with most strapping material, while still providing adequate friction to engage a variety of material thicknesses. It shall be understood that strapping material may include any material used for securing loads, including but not limited to rope, cable, twine, wire, and banding material constructed of steel, polypropylene, polyester, nylon, woven, paper, composite, or a combination thereof.

Still referring to FIG. 3B, cleat further comprises a longitudinal channel 310 located below the plurality of oppositely opposed teeth. The cleat, when positioned inside the longitudinal slot, features a channel running the entire length of the cleat. This presents a clear passageway through the slot and cleat, due to the U-shaped bottom of the longitudinal slot aligning on the same plane as that of the channel. The channel serves multiple functions. First, if the cleat needs to be removed for general maintenance or replacement, a user may use the longitudinal channel to pry the cleat from the slot by using a common screwdriver. Second, the longitudinal gap is designed to allow any accumulation of debris to be cleared through the channel and slot, with a small amount of pressurized air. Specifically, if the cleat is removed for maintenance, water or other fluid may be flooded through the channel to clear any accumulated debris.

Figure 4A:
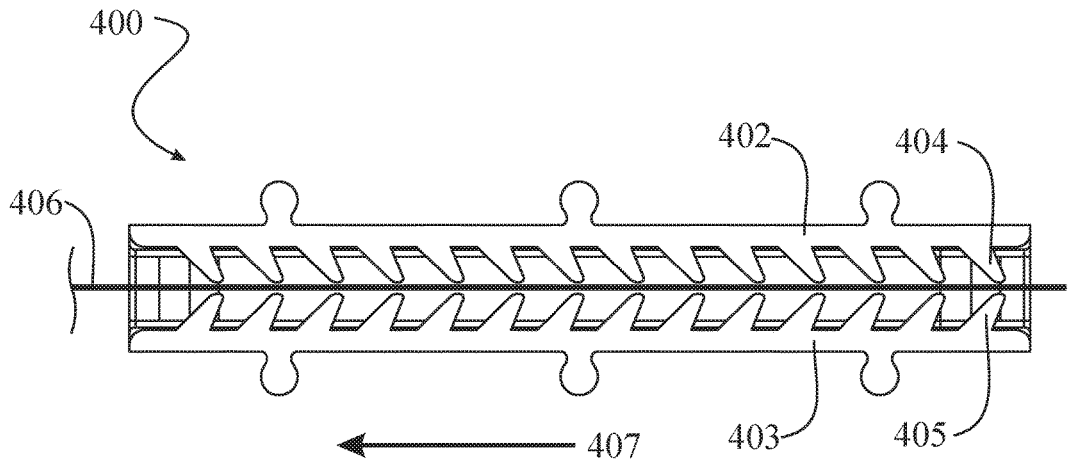
FIG. 4A is a top isolated view of a cleat in a disengaged position according to an embodiment of the present invention.

FIG. 4A is a top isolated view of a cleat in a in a disengaged position 400 according to an embodiment of the present invention. Referring now to FIG. 4A, the cleat comprises side walls 402/403 having a plurality of oppositely opposed teeth 404/405. For illustrative purposes, the cleat is isolated from the other components of the apparatus. Strapping material 406 is placed into the cleat between the plurality of oppositely opposed teeth. The strapping material is typically provided on a reel or coil, as well known in the art. In operation, the end section of the strapping material is slid between the plurality of oppositely opposed teeth from above, and pulled in a first direction 407 causing the plurality of oppositely opposed teeth to flex and engage the strapping material, as seen in FIG. 4B.

Figure 4B:
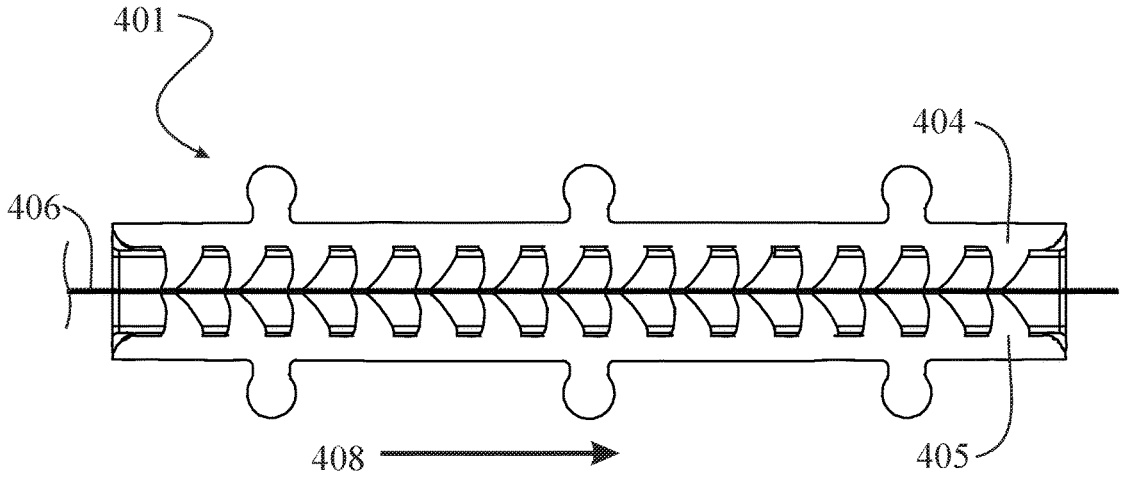
FIG. 4B is a top isolated view of a cleat in an engaged position according to an embodiment of the present invention.

FIG. 4B is a top isolated view of the cleat in an engaged position 401 according to an embodiment of the present invention. As previously mentioned, in the engaged position the plurality of oppositely opposed teeth remain flexed, securing the strapping material in the cleat. At this time the apparatus and engaged strapping are ready to be threaded through a pallet, which will be discussed in greater detail below. After operation completion, the strapping material is pulled in a second direction 408 disengaging the plurality of oppositely opposed teeth releasing the strapping material, as seen in FIG. 4A. It shall be understood, that the engaged position may also be referred as the closed position. Likewise, the disengaged position may also be referred as the opened position.

Figure 5:
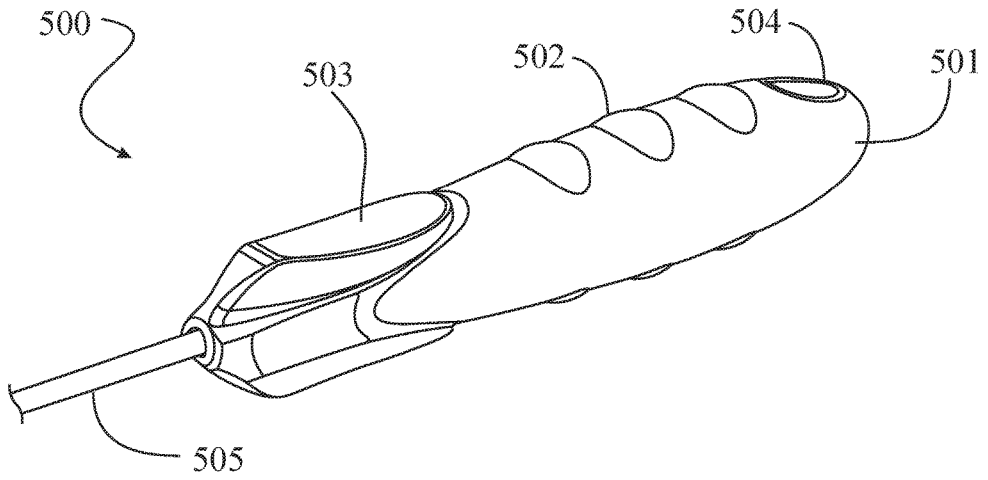
FIG. 5 is a detailed view of a directional handle component of the pallet threading apparatus according to an embodiment of the present invention.

FIG. 5 is a detailed view of a directional handle component 500 of the pallet threading apparatus according to an embodiment of the present invention. Referring now to FIG. 5, the directional handle comprises an elongated handle body 501 including finger grooves 502, thumb guide 503, and hanger hole 504. The finger grooves and thumb guide ensure the user's hand is in an operable position to operate the apparatus while providing comfort. When held by the hand in a most natural position during operation, the thumb guide, aligned with the finger grooves in an upright manner, ensures the apparatus, and specifically the head member 101 (FIG. 1) is always correctly oriented. The hanger hole allows the apparatus to be stored by means of a hook, as well known in the art. Like the head member (FIG. 1; 101), the handle has no blunt surface or protrusions that would impede its progress if also passed through a pallet, such as when threading multiple adjacent pallets which is common in the art. In some embodiments, the directional handle is constructed from other shapes that have no blunt edges or protrusions that would cause the handle to be impeded by the many surfaces of a common wood pallet. As mentioned previously, the handle is attached to flexible rod 505 using suitable attachment means as well known in the art.

FIG. 6 is an exemplary perspective view illustrating a pallet threading apparatus 600 in use according to an embodiment of the present invention. Referring now to FIG. 6, the pallet threading apparatus comprises head member 601, flexible rod 602, and directional handle 603. The head member includes engaged strapping material 604. During operation, the pallet threading apparatus and specifically the head member is inserted through pallet 605 at any available opening 606/607 located on the pallet. For exemplary purposes, a common stringer style pallet is illustrated, having main openings 606 and notched openings 607, as well known in the art. It is understood that the apparatus may be used on a variety of pallet designs including any deckboard style pallet solid-top style pallet, including but not limited to two-way or four-way entry pallets, featuring block, stringer, or skid styles, with flush, single or double wing deckboards and made of wood, metal, paper, plastic, or other material.

During operation, as pallet threading apparatus 600 is inserted or threaded through pallet 605 at available openings 606/607, the inventive features of the apparatus allows the head member and attached strapping to be passed through the pallet from approximately any angle or position. For instance, a user may remain in a standing position while threading the pallet with the apparatus due to the flexibility of the rod. Further, the flexible rod allows the apparatus, and specifically the head member and its plurality of rails to be propelled forward through the pallet's openings regardless of the angle in which the apparatus is being inserted, as the head member will naturally be inclined to go in a continuous forward motion directly through the pallet. Once the apparatus is successfully passed through the pallet, the user may remove the strapping material from the cleat, in the manner previously discussed, and use the strapping material to secure a load to the pallet, as well known in the art.

Figure 7A:
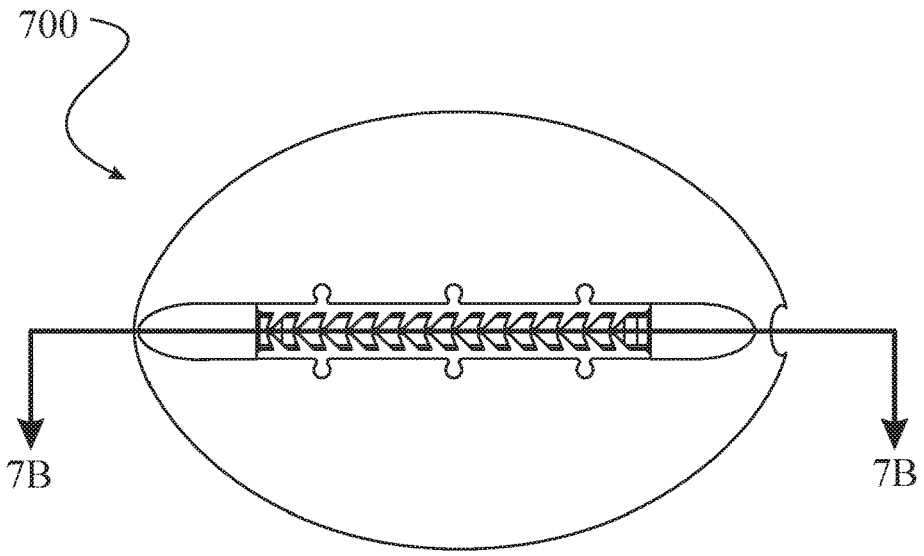
FIG. 7A is a top detailed view of a pallet threading apparatus according to an embodiment of the present invention.
Figure 7B:
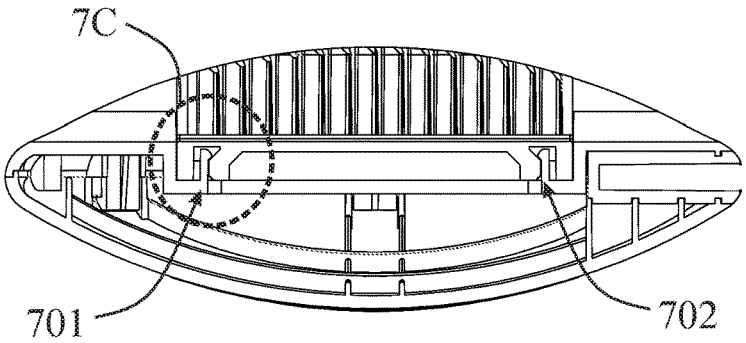
FIG. 7B is a cross-sectional view taken along section line 7B-7B of FIG. 7A.
Figure 7C:
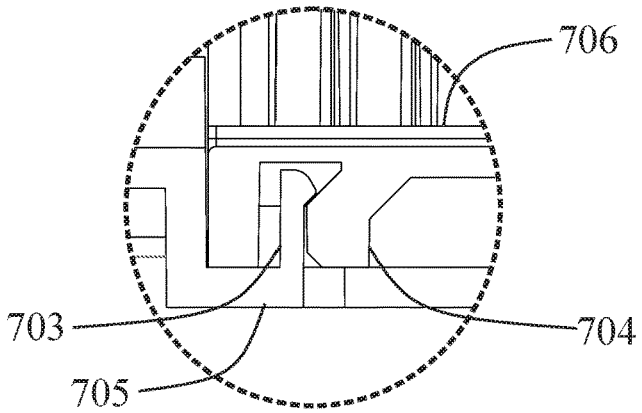
FIG. 7C is a detailed view taken from detail 7C of FIG. 7B.

FIG. 7A is a top detailed view of a pallet threading apparatus according to an embodiment of the present invention. Specifically, head member 700 is illustrated. FIG. 7B is a cross-sectional view taken along section line 7B-7B of FIG. 7A. Referring now to FIG. 7B, the apparatus comprises at least one fastening means 701/702 as previously mentioned. FIG. 7C is a detailed view taken from detail 7C of FIG. 7B. Referring now to FIG. 7C, the details of the at least one fastening means are illustrated. At least one fastening means includes a rectangular male fastener 703 and a corresponding female fastener receiving space 704. The rectangular male fastener is attached to longitudinal slot 705 and the female fastener receiving space is attached to cleat 706. Preferably, the apparatus includes at least two fastening means, having a first fastening means on one end of the cleat and a second fastening means on the opposite end of the cleat.

Figure 8:
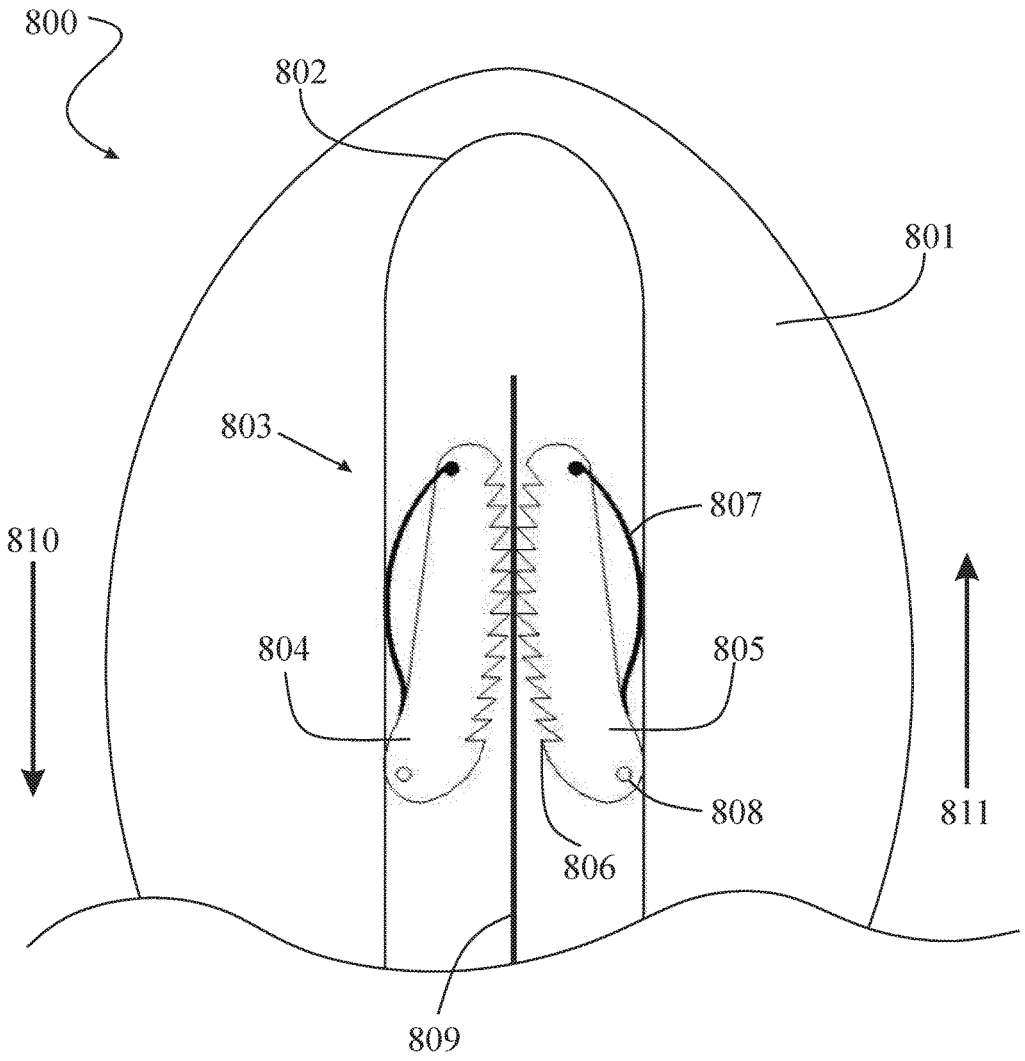
FIG. 8 is a top detailed view of a pallet threading apparatus according to an embodiment of the present invention.

FIG. 8 is a top detailed view of a pallet threading apparatus 800 according to an embodiment of the present invention. It shall be understood, that a variety of methods may be used to secure strapping material in the pallet threading apparatus. In one embodiment, a unidirectional friction-based cleat device 803 positioned in longitudinal slot 802 on head member 801 is provided. The cleat device comprises a pair of cam members 804/805 each having a plurality of teeth 806 having sharp edges. Each cam member including a tension spring 807 and hinge pin 808. The hinge pin allowing the cam member to pivot as well known in the art. Similarly to the previously mentioned cleat (FIG. 2), strapping material 809 may be placed between the plurality of teeth. The strapping material may pulled in a first direction 810, closing the cam members and corresponding teeth to engage the strapping material. The strapping material and cam members are secured in place via the tension spring, as well known in the art. The apparatus functions similarly as previously mentioned during operation. Once completed, the strapping material may be pulled in a second direction 811, releasing the cam members and disengaging strapping material from the cleat device. Any of the cleat devices described above may be constructed from a variety of materials, including but not limited to metal or plastic.

Although the invention has been described in considerable detail in language specific to structural features, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A pallet threading apparatus comprising:

a directional handle;

a flexible rod having a first end and a second end;

a football-shaped head member having a top portion and a bottom portion, the top portion including a longitudinal slot;

the directional handle is attached to the first end and the football-shaped head member is attached to the second end;

a cleat element positioned in the longitudinal slot, the cleat element comprising a pair of side walls having a plurality of oppositely opposed teeth for retaining a section of strapping material.

2. The pallet threading apparatus of claim 1, wherein the pair of side walls each having a number of protruding studs corresponding to a number of receiving spaces located in the top portion.

3. The pallet threading apparatus of claim 1, further comprising at least one rectangular female receiving area in a bottom of the cleat element, corresponding to at least one rectangular male fastener in a bottom of the longitudinal slot.

4. The pallet threading apparatus of claim 1, wherein each of the plurality of oppositely opposed teeth includes a top surface, a distal surface, and a bottom surface.

5. The pallet threading apparatus of claim 4, wherein the longitudinal slot has a substantial U-shape configuration on plane with a longitudinal channel located below the bottom surface of the plurality of oppositely opposed teeth, extending the length of the cleat, creating a continuous passageway for debris to clear.

6. The pallet threading apparatus of claim 4, wherein the top surface comprises an angled surface.

7. The pallet threading apparatus of claim 6, wherein the angled surface enables the section of strapping material to be easily centered in the plurality of oppositely opposed teeth.

8. The pallet threading apparatus of claim 4, wherein the distal surface has a slight angle in relation to the bottom surface.

9. The pallet threading apparatus of claim 8, further comprising a distance between the distal surfaces of the plurality of oppositely opposed teeth, wherein the distance varies by depth due to the slight angle creating a first depth and a corresponding first distance adjacent to the top surface and a second depth and a corresponding second distance adjacent to the bottom surface, wherein the first distance is greater than the second distance.

10. The pallet threading apparatus of claim 9, wherein the distance between the distal surfaces of the plurality of oppositely opposed teeth enables various sized strapping materials to be used.

11. The pallet threading apparatus of claim 1, wherein the directional handle comprises a thumb guide aligned with the cleat element.

12. The pallet threading apparatus of claim 1, wherein the plurality of oppositely opposed teeth are constructed from an elastic material enabling the plurality of oppositely opposed teeth to flex, the flex enabling the plurality of oppositely opposed teeth to include an open position and a closed position, wherein the section of strapping material is loaded in the open position and retained in the closed position.

13. The pallet threading apparatus of claim 5, wherein the longitudinal channel allows an accumulation of debris to be cleared by applying pressurized air to the channel.

14. The pallet threading apparatus of claim 1, wherein the bottom portion includes a plurality of rails stabilizing the head member in an upright position during operation.

15. A threading apparatus comprising:

a handle;

a flexible rod having a first end and a second end;

a spheroid-shaped head member having a top portion and a bottom portion, the top portion including a longitudinal slot;

the handle is attached to the first end and the head member is attached to the second end;

a cleat element positioned in the longitudinal slot, the cleat element comprising a pair of elements having a plurality of oppositely opposed teeth for retaining a strip of strapping material.

16. The apparatus of claim 15, wherein the head member is constructed from a shape including no blunt edges or protruding surfaces.

17. The apparatus of claim 15, wherein the plurality of oppositely opposed teeth includes an open position and a closed position, wherein the strip of strapping material is loaded in the open position and retained in the closed position.

18. The apparatus of claim 15, wherein the handle is constructed from a shape including no blunt edges or protruding surfaces.

19. The apparatus of claim 15, wherein the flexible rod is constructed from fiberglass allowing the flexible rod to bend in any 360 degree direction.

* * * * *